US007281386B2

(12) United States Patent
McDougal et al.

(10) Patent No.: US 7,281,386 B2
(45) Date of Patent: Oct. 16, 2007

(54) RESIDENTIAL ICE MACHINE

(75) Inventors: Gregory S. McDougal, Manitowoc, WI (US); Michael J. Rimrodt, Green Bay, WI (US); Richard A. Abegglen, Manitowoc, WI (US)

(73) Assignee: Manitowoc Foodservice Companies, Inc., Reno, NV (US)

( * ) Notice: Subject to any disclaimer, the term of this patent is extended or adjusted under 35 U.S.C. 154(b) by 225 days.

(21) Appl. No.: 11/152,646

(22) Filed: Jun. 14, 2005

(65) Prior Publication Data

US 2006/0277928 A1 Dec. 14, 2006

(51) Int. Cl.
*F25C 1/12* (2006.01)

(52) U.S. Cl. ..... 62/74; 62/157; 62/233; 62/347

(58) Field of Classification Search ..... 62/66–74, 62/135–137, 303, 340–356, 233, 157–158
See application file for complete search history.

(56) References Cited

U.S. PATENT DOCUMENTS 4,075,865 A 2/1978 Wills
4,197,717 A * 4/1980 Schumacher ..... 62/213
4,257,237 A 3/1981 Hoenisch
4,505,130 A 3/1985 Hibino et al.
4,602,489 A 7/1986 Hara
4,619,117 A 10/1986 Ito
4,733,539 A * 3/1988 Josten et al. ..... 62/73
4,910,974 A 3/1990 Hara
5,025,637 A 6/1991 Hara
5,027,610 A 7/1991 Hara
5,035,118 A 7/1991 Hara
5,419,151 A 5/1995 Minari et al.
5,524,448 A 6/1996 Schwanebeck et al.
5,533,352 A 7/1996 Bahel et al.
5,752,393 A 5/1998 Schlosser et al.
5,806,330 A 9/1998 Falkowski et al.
5,878,583 A 3/1999 Schlosser et al.
5,901,561 A * 5/1999 Allison et al. ..... 62/126
6,058,731 A 5/2000 Byczynski et al.

(Continued)

*Primary Examiner*—William E. Tapolcai
(74) *Attorney, Agent, or Firm*—Brinks Hofer Gilson & Lione; Steven P. Shurtz

(57) ABSTRACT

An automatic ice making machine includes a refrigeration system comprising a compressor, a condenser, an evaporator and an expansion device; a water system comprising an ice forming surface in thermal contact with the evaporator; and a control system comprising i) an on/off selector that causes the control system to either operate the compressor and water system so that the ice making machine automatically makes ice, or shuts the machine off until manually turned on; and ii) an automatic restart selector that causes the control system to shut down ice making for a predetermined period of time and then automatically resume ice making. Preferred embodiments of the a water system comprise a water filter and the control system comprises a filter change indicator, whereby an indication is displayed after a predetermined condition is reached indicating that the water filter should be replaced. Also, the control system preferably comprises a sensor to determine the temperature of the liquid line and a program that controls operation of the condenser fan during a harvest mode based on the temperature of the liquid line. Further, the preferred control board is changeable so that it can be used to appropriately control different models of ice making machines, with a microprocessor determining different durations of freeze and harvest cycles based on the same sensor temperature, depending on the changed aspect of the control board.

65 Claims, 8 Drawing Sheets

U.S. PATENT DOCUMENTS 6,101,833 A 8/2000 Suzuki
6,119,469 A 9/2000 Elwood
6,120,685 A 9/2000 Carlson et al.
6,148,621 A 11/2000 Byczynski et al.
6,216,479 B1 4/2001 Elwood
6,257,009 B1 7/2001 Tsuchikawa
6,303,031 B1 10/2001 Senner et al.
6,311,501 B1 * 11/2001 Allison et al. ..... 62/74
6,355,177 B2 3/2002 Senner et al.
6,375,834 B1 4/2002 Guess et al.
6,438,973 B1 8/2002 Yoshida et al.
6,453,696 B1 9/2002 Kawasumi et al.
6,502,416 B2 * 1/2003 Kawasumi et al. ..... 62/347
6,612,126 B2 9/2003 Kawasumi et al.
6,613,236 B1 9/2003 Guess et al.
6,705,107 B2 3/2004 Schlosser et al.
2003/0009610 A1 1/2003 Nolan et al.
2003/0182958 A1 10/2003 Gray et al.
2004/0226312 A1 11/2004 Miller et al.
2005/0044875 A1 3/2005 Schlosser et al.

* cited by examiner

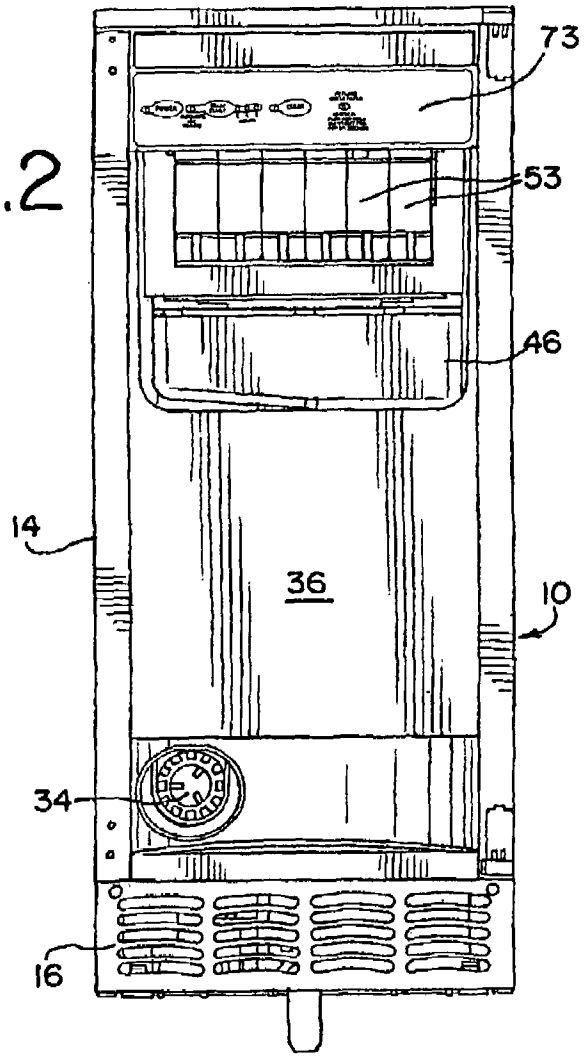
FIG.2
FIG.1
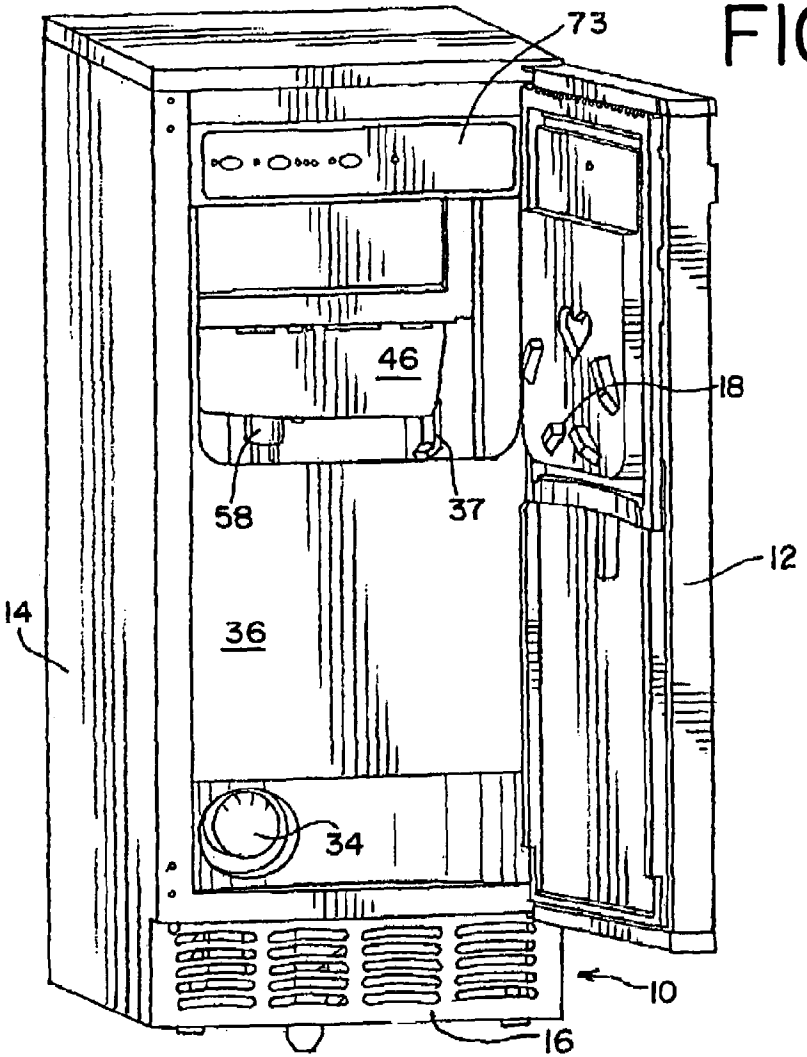

RESIDENTIAL ICE MACHINE

BACKGROUND OF THE INVENTION

The present invention relates to ice making machines and particularly to control methods for automatic ice making machines. The invention particularly relates to a control system that includes one or more of the following: automatic restart, condenser fan control, harvest and freeze cycle duration control, and timing for changing a water filter.

Numerous automatic ice making machines have been developed over the years. Most of these machines have been free-standing units that are connected to electrical and water supplies and make ice using a standard refrigeration system. The ice machines often have a control system which automatically operates the machine through freeze and harvest cycles, and which turns the machine off when sufficient supplies of ice have been made.

Many times an ice machine is located in a place where the noise of the ice machine is objectionable. For example, an automatic ice making machine may be located under the counter in a kitchen, in a conference room, or in a sky box at a sports stadium. While the noise from the ice machine does not present a problem during most hours of the day, there may be times when individuals in its vicinity would like to shut the ice machine off, such as when speaking on the telephone in the kitchen, or when entertaining guests. As frequently happens, people will unplug or turn off an ice machine in these circumstances, and then forget to plug it back in or turn it back on when their conversation is over or the guests leave. Often the fact that the ice machine has been turned off is not noticed until it is too late to restart the machine and produce adequate quantities of ice before the ice is needed.

Such ice machines come in all sizes, from large machines that make hundred of pounds of ice in an hour, to smaller machines which make a few pounds of ice an hour. The control systems for such machines vary from sophisticated to simple.

Many cube ice making machines use a hot gas bypass valve to harvest the cube ice by sending hot refrigerant from a compressor directly to an evaporator mounted on the back of a cube forming evaporator plate. Instead of freezing water into ice, the evaporator then melts the ice. Knowing when to start and end the harvest cycle is important. The maximum efficiency of the machine requires that the harvest cycle be started when ice has formed sufficiently, and stopping the harvest cycle as soon as the ice is released from the ice forming evaporator plate. Prior art patents disclose the use of ice thickness sensors to initiate a harvest cycle, and an electro-mechanical sensor, such as a water curtain switch, to detect when the ice cubes fall off of the ice-forming evaporator plate. There are numerous other control sensors and mechanisms to start and stop the harvest cycle.

One problem with many of the sophisticated control systems is that they require components that add significant cost to the ice making machine. On relatively small ice machines, where the manufacturing cost is minimized, a trade off is made in that the control system does not operate the machine in the most efficient manner. For example, in some ice machines, the durations of the freeze and harvest cycles are based on a sensor which measures the temperature or pressure of the refrigerant on the suction side of the compressor. Other systems use a thermostat on the evaporator or outlet of the evaporator. In these systems, when a predetermined temperature is reached, the machine changes to a harvest cycle, and when another temperature is reached, they change back to a freeze cycle. When the ambient air is warmer, the freeze cycle duration is longer. Some such systems include an adjustment knob so that the cycle time can be increased or decreased as desired if ice cube thickness is too great or too small.

One problem with such a simple control system is that it does not automatically take into account several variables. For example, the optimum freeze and harvest cycle durations will depend not only on ambient air temperatures, but on such factors as how clean the condenser is, and whether any foreign objects are blocking the flow of air past the condenser. The adjustment knob can be used to adjust the cycle times as these factors change, but this often requires a service technician, or is not done properly. As a result, the machines may not produce sufficient ice, and they have higher operating costs than necessary.

U.S. Pat. No. 5,878,583 disclose an ice machine that solves many of the aforementioned problems, using a simple control mechanism to initiate a harvest cycle without the use of a water level sensor or ice thickness sensor, which is inexpensive so that it can be used on small ice machines but which greatly improves the efficiency of the machine compared to simple control systems known theretofore. The improved control system starts and stops the harvest cycle dependent on varying conditions, including not only ambient temperature, but increasing amounts of dirt on condenser coils and partial blockage of air flow past the condenser coil.

However, even further improvements are desirable. First, ice machines operate in different ambient conditions, which sometimes change over the course of a year or even throughout the day. The efficiency of the operation of the ice machine can be improved if the fan used to cool an air-cooled condenser is only used when needed. For example, during the freeze cycle, the fan should be operating to remove as much heat from the refrigerant as possible. However, if the ice machine uses a hot gas defrost in the harvest cycle, the defrost time may be unnecessarily long, or not even occur at all, if the condenser fan operates continuously. On the other hand, if the fan is off during every defrost cycle, more heat may build up in the refrigeration system than is needed, depending on the ambient air temperature. For example, in hot ambient conditions, the condenser fan should normally be operating during harvest, or the harvest bypass refrigerant will get too hot and take longer than necessary to cool back down when the machine switches back over into a freeze mode. Hence, it would be beneficial to be able to control the condenser fan to only operate during harvest cycles in which it is needed.

U.S. Pat. No. 4,257,237 discloses a spray-type ice machine in which a first thermistor is used to sense the ambient air temperature and control the harvest duration. Another thermistor is used to control the condenser fan during the harvest cycle. The second thermistor senses high temperatures in the condenser and the fan is turned off and on based on the condenser temperature to keep the condenser in a desired temperature range. One drawback to this system is that if the temperature gets to a point that the fan is turned on, it is very possible that more heat than was needed for efficient defrost has already built up in the system, and the next freeze cycle will be unnecessarily long because the extra heat has to be removed.

Ice machines that use a capillary tube instead of a TXV valve to control the flow of refrigerant to the evaporator are particularly in need of control improvements. While a capillary tube is less expensive that a TXV valve, capillary tubes are generally only used on machines that are used where there is not a wide swing in the ambient temperature. If someone wanted to put an ice making machine in an unheated garage, it might be called on to operate over ambient temperatures ranging from 20° F. to 120° F. It would be beneficial if a control system could be developed that would allow ice machines with capillary tubes to be efficiently operated, even if the machine were located in an area with a wide swing of ambient temperatures.

There are instances where the freeze cycle duration and/or harvest cycle duration for a given ice machine would be beneficially altered for a given machine, such as where a user wishes to have larger or smaller ice cubes, or to deal with variations in the refrigeration components from one machine to the next. However, if the freeze and/or harvest cycle times were totally under the control of the end user, many people would not know how to properly adjust the times. Thus it would be beneficial if a control system for a ice making machine could be developed that had a simple way to adjust the freeze and/or harvest cycle duration, while using a control system that automatically accounted for most variables (such as ambient air and inlet water temperature, and any dirt build up on the condenser) to efficiently produce ice.

Another drawback relating to many automatic ice making machines is that several different models of ice machine are made by a manufacturer, and the control board used in each model of machine has to be separately designed, produced and kept in inventory until that model of ice machine is being manufactured. For example, some models of ice making machines are very similar to one another in size and components, but differ in the size of ice cube that they make. Unfortunately, the shape of the ice forming mold has a significant impact on the optimum duration of the freeze and harvest cycles. Thus, just using a different evaporator/ice-forming mold to make different sizes of cubes in the otherwise identical machine would require a manufacturer to stock two different control boards. The cost for the separate design, production and inventory of multiple control boards must, of course, be recouped in the sales price of the machine. Thus there would be a great benefit if a control system could be developed that could be used to control several different models of ice machines but used on a common control board.

Water filters are sometimes highly desirable on automatic ice making machines, where the water supply includes objectionable minerals, odors or other contaminants that could end up in the ice. Most water filters are designed to be used for a period of time and then replaced. If the water filter is not replaced soon enough, it will loose its efficacy. On the other hand, if it replaced more frequently than needed, unused filtration capacity is paid for and wasted. Many appliances that include a water filter have an indicator to show that the filter should be changed, but these indicators are typically based strictly on the length of time that the appliance has been running. One problem with replacing the water filter on an automatic ice making machine is that the amount of water used by the machine, and hence cleaned by the filter, may vary greatly, depending on the location and type of use to which the machine is put. Therefore there would be great benefit in a control system that would remind a user to change a water filter at an appropriate time for the specific machine on which it is installed.

SUMMARY OF THE INVENTION

A control system has been invented which can overcome one, two or more, or all of the forgoing deficiencies with prior art control systems.

In a first aspect, the invention is an automatic ice making machine comprising: a refrigeration system comprising a compressor, a condenser, an evaporator and an expansion device; a water system comprising an ice forming surface in thermal contact with the evaporator; and a control system comprising i) an on/off selector that causes the control system to either operate the compressor and water system so that the ice making machine automatically makes ice, or shuts the machine off until manually turned on; and ii) an automatic restart selector that causes the control system to shut down ice making for a predetermined period of time and then automatically resume ice making.

In a second aspect, the invention is a method of operating an automatic ice making machine having a refrigeration system comprising a compressor, a condenser, an evaporator and an expansion device; a water system comprising an ice forming surface in thermal contact with the evaporator; and a control system; the method comprising putting the control system into a mode where the refrigeration and water systems are used to automatically form and harvest ice; signaling the control system to stop automatically forming and harvesting ice for a predetermined period of time during which the refrigeration and water systems are inactive; and the control system automatically resuming the ice forming and harvesting mode after the expiration of the predetermined period of time without user intervention.

In a third aspect, the invention is an automatic ice making machine comprising a refrigeration system comprising a compressor, a condenser, an evaporator and an expansion device; a water system comprising a water filter and an ice forming surface in thermal contact with the evaporator; and a control system that controls the refrigeration system to make and harvest ice on an automatic basis, and comprising a filter change indicator, whereby an indication is displayed after a predetermined condition is reached indicating that the water filter should be replaced.

In a fourth aspect, the invention is an automatic ice making machine comprising a refrigeration system comprising a compressor, a condenser having an inlet and an outlet, a condenser fan, an evaporator, an expansion device and a liquid line for transferring refrigerant from the condenser to the expansion device; a water system comprising an ice forming surface in thermal contact with the evaporator; and a control system comprising a sensor to determine the temperature of the liquid line and a program that controls operation of the condenser fan during a harvest mode based on the temperature of the liquid line.

In a fifth aspect, the invention is a method of controlling a condenser fan of an ice making machine comprising the steps of: a) initiating a freeze cycle during which refrigerant is compressed by a compressor and discharged to a condenser, from which the refrigerant flows in a liquid line to an expansion device, through an evaporator and back to the compressor; b) measuring the temperature of the refrigerant leaving the condenser at a predetermined time before termination of the freeze cycle; and c) using the temperature measured in step b) to determine whether the condenser fan should operate during the harvest cycle.

In a sixth aspect, the invention is an automatic ice making machine comprising: a refrigeration system comprising a compressor, a condenser having an inlet and an outlet, a condenser fan, an evaporator, an expansion device and a liquid line for transferring refrigerant from the condenser to the expansion device; a water system comprising an ice forming surface in thermal contact with the evaporator; and a control system comprising a sensor to determine the temperature of the liquid line and a control board having a microprocessor thereon programmed to use input from the sensor to determine at least one of a desired duration of a freeze cycle and a desired duration of a harvest cycle, and to thereafter control the refrigeration and water systems to operate in accordance with the desired duration or durations; the control board being changeable so that it can be used to appropriately control different models of ice making machines, with the microprocessor determining different durations based on the same sensor temperature, depending on the changed aspect of the control board.

In a seventh aspect, the invention is a method of controlling a harvest cycle duration of an ice making machine comprising the steps of: a) initiating a freeze cycle during which refrigerant is compressed by a compressor and discharged to a condenser, from which the refrigerant flows in a liquid line to an expansion device, through an evaporator and back to the compressor; b) measuring the temperature of the refrigerant leaving the condenser at a predetermined time before termination of the freeze cycle; c) using the temperature measured in step b) and a controllable factor to determine the desired duration of a harvest cycle during which refrigerant bypasses the condenser and flows to the evaporator; and d) ending the harvest cycle after the length of time determined in step c).

In a eighth aspect, the invention is a method of manually modifying at least one of a freeze cycle duration and harvest cycle duration of an ice making machine comprising the steps of: a) initiating a freeze cycle during which refrigerant is compressed by a compressor and discharged to a condenser, from which the refrigerant flows in a liquid line to an expansion device, through an evaporator and back to the compressor, and continuing the freeze cycle for a first period of time; and b) initiating a harvest cycle during which refrigerant bypasses the condenser and flows to the evaporator, and continuing the harvest cycle for a second period of time; c) the first and second periods of time being determined by a microprocessor and based on i) at least one input from a sensor, and ii) a manually entered modification input from a user interface, the modification input thus manually modifying at least one of the first and second time periods from what would otherwise have been determined by the microprocessor from the at least one sensor input without the modification input.

By using an automatic restart selector, a person can turn off the ice machine when they want it to be quiet, and not have to remember to turn it back on, or run the risk of not having ice when desired.

By using a sensor to determine the temperature of the refrigerant (liquid line) leaving the condenser and a program that controls operation of the condenser fan during the harvest mode based on the temperature of the liquid line at a predetermined time prior to the termination of the freeze cycle, the condenser fan can be stopped just as the harvest cycle begins, but only on those cycles where additional heat removal would be detrimental to the overall efficiency of the machine. Hence a more efficient operation can be achieved, even over different condenser cleanliness, air flow blockage and ambient air and water temperature conditions. Further, by including a controllable factor into the system controller that can be used to adjust the duration of the freeze and/or harvest cycle, an optimized cycle times can easily be achieved for any given machine.

The preferred control boards of the present invention can be used on more than one model of ice machine, making it possible for the manufacture to cut down on design and parts cost, as well as the cost of having an inventory of a plurality of different control boards.

By including a filter change indicator in an ice machine, a person can know whether the filter needs to be changed without waiting for the ice quality to deteriorate, but without discarding a filter that has unused capacity.

These and other advantages of the invention will be best understood in view of the attached drawings, a brief description of which follows.

BRIEF DESCRIPTION OF THE DRAWINGS

FIG. 1 is a perspective view of an ice machine of the present invention.

FIG. 2 is a front view of the ice machine of FIG. 1 with the door removed.

FIG. 11 is used for the model of the ice machine of FIG. 1 that makes regular size cubes, and FIG. 12 is used for the model that makes the smaller cubes.

DETAILED DESCRIPTION OF THE DRAWINGS AND PREFERRED EMBODIMENTS OF THE INVENTION

Figure 3:
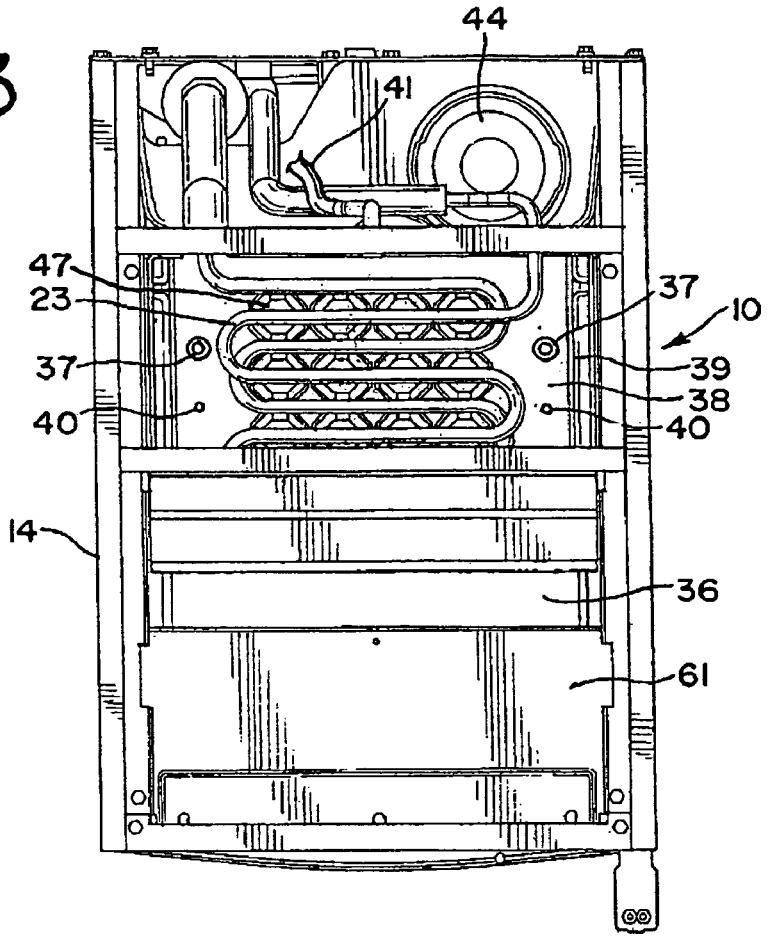
FIG. 3 is top view of the ice machine of FIG. 1 with the top cover and door removed.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

A preferred embodiment of an ice making machine 10 incorporating the present invention is shown in FIGS. 1-7. While the machine shown is primarily designed for residential use, the invention is applicable to other types of ice machines as well. While the term "ice cube" is used throughout the present application, it is understood that the ice formed by the machine does not need to be in the shape of a cube. Some well known ice cube shapes include cylindrical, rectangular, pillow shaped, and even half-circular.

The ice making machine 10 is housed within a cabinet 14 that has insulated walls on its upper portion and a base containing some of the mechanical components. A door 12 (shown in FIG. 1 but removed from the other figures for sake of clarity) fits over the front opening of the cabinet 14. The front of the base section of the machine is covered by a grill 16 that allows air to pass through the base compartment. The door 12 preferably includes brackets 18 on the inside to hold an ice scoop (not shown) so the scoop is handy when someone wishes to remove ice from the machine 10.

Inside the ice making machine 10 there is an ice storage bin 36 that sits above the base compartment of the machine. The machine includes a water system, a refrigeration system and a control system, each explained in detail below. The water system includes a water circulation mechanism, preferably in the form of a pump 44 (FIG. 3) of conventional design. The base of the pump sits in a water reservoir 46 attached to the inside of the cabinet 14 above the ice bin 36. Preferably the reservoir is formed with clips 37 on their bottom which include extensions that snap into recesses in the side walls of the ice bin 36.

The motor that runs the pump is separated from the food zone, and the pump is mounted so that it can be removed without tools, as disclosed in FIGS. 28-35 of U.S. Patent Application Publication No. 2004-0226312, which is incorporated herein by reference. The only significant difference with the ice machine 10 of the present application is that the discharge from the pump connects directly to a hose (discussed below) rather than to a fitting formed in the panel member on which the pump is mounted.

Figure 5:
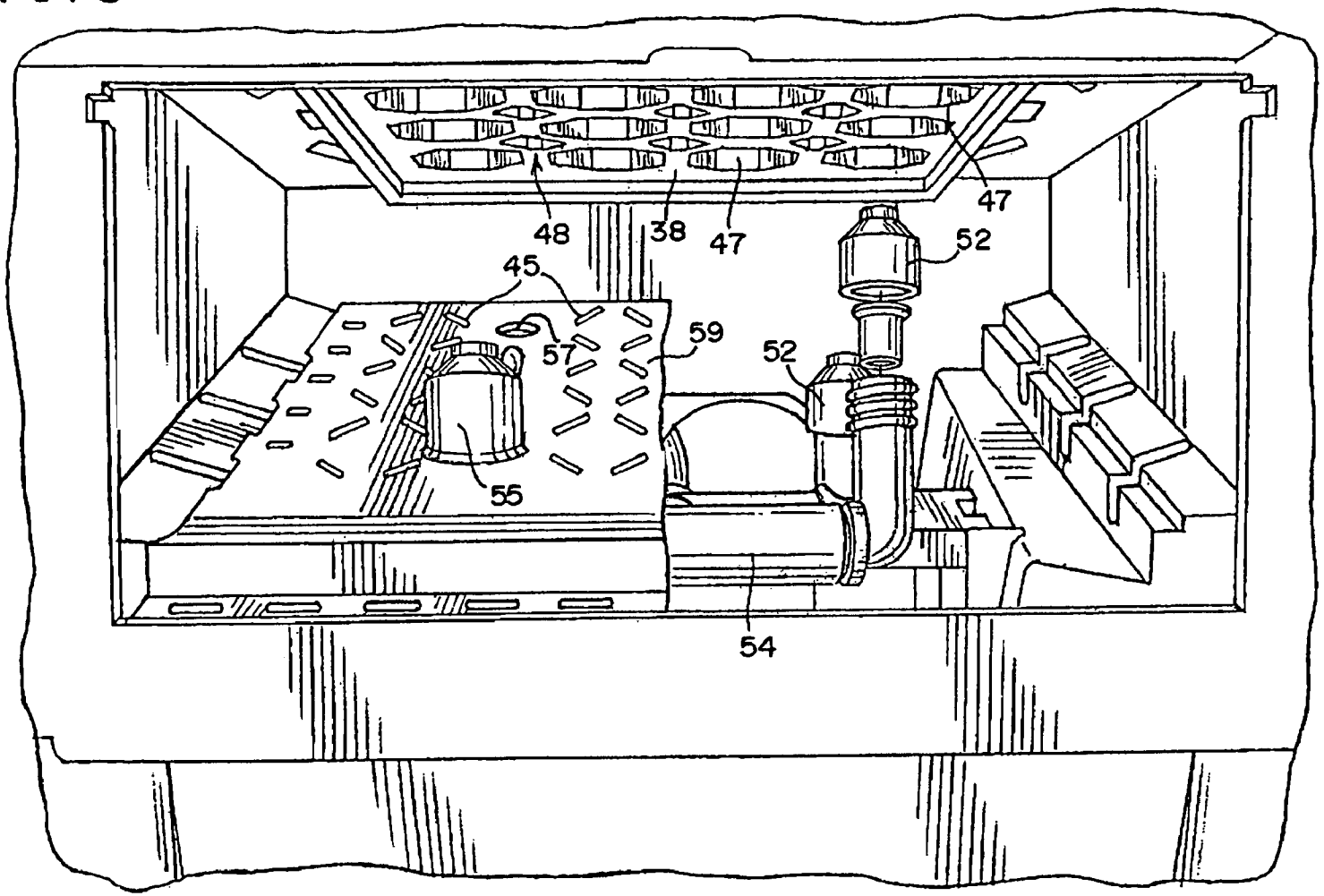
FIG. 5 is a perspective view inside of the ice making section of the ice machine of FIG. 1.

Water enters the machine 10 through a fresh water inlet 41, preferably controlled by a water inlet solenoid valve 42 (FIG. 5) after passing through water filter 34. Water filter 34 is accessible from the front of the machine 10 when the door is open, as shown in FIG. 1. The water eventually fills the reservoir 36. Excess water is allowed to overflow a stand tube (not shown) and flow out of a drain line 58, best seen in FIG. 1. During cleaning operations, the reservoir may preferably be drained by pulling out the stand tube. Water from the pump 44 travels though a water hose (not shown) into the back of a spray assembly 54 and feeds four individual spray nozzles 52, from which it sprays up into a plurality of inverted cups 47 in an ice forming device 48 (see FIG. 5) located above the water reservoir 46. Water that does not freeze flows back into the reservoir 46 through holes 45 in ice diverter plate 59. Plate 59 also includes holes 57 that allow water to spray up through the plate from the nozzles 52. The nozzles in the front of the ice forming section are protected from falling ice cubes by shields 55 that are formed integrally with the rest of plate 59. Water that splashes towards the front of the ice making section is caught by pivotable plates 53 (FIG. 2) that hang down to close off the ice making section, but which can swing open to allow ice cubes to fall into the ice bin 36 during harvest. The plates 53 are suspended on a metal rod (not shown) that reaches across the top front of the ice making section. FIG. 5 shows the ice making section with these plates 53 removed for sake of clarity. Further details about the ice making section not needed to understand the invention are not given, as the ice making section is essentially the same as the ice making section of the Model EC18 ice making machine from Manitowoc Ice, Inc. 2110 S. 26th St., Manitowoc, Wis. 54220.

The ice-forming device 48 is preferably constructed the same way as the ice forming plate also used in the Model EC18 ice making machine. The cups 47 are made from stamped pieces of copper, which are then plated. The cups form individual pockets in which ice cubes are formed. As best seen in FIG. 3, tubing 23 forming the evaporator section of the refrigeration system is formed into a serpentine pattern and soldered to the back side of the cups 47. The ice-forming device 48 is preferably made by insert injection molding the plated cups so that plastic components are molded onto the cups, holding the assembly together and forming a tray 38. The tray 38 includes a lip 39 around its outside top perimeter that creates a small reservoir on the top side of the tray 38. During the harvest mode, when fresh water is introduced through inlet 41, the water floods the top side of the tray 38, helping to warm the cups 47 so that they release the cubes of ice formed in the cups 47. Short standpipes 37 surround holes through the tray 38. This keeps the level of water on the top of the tray to the height of these standpipes. Other, smaller holes 40 allow the water to completely drain out of the tray once the water stops flowing in on top of the tray 38.

Figure 6:
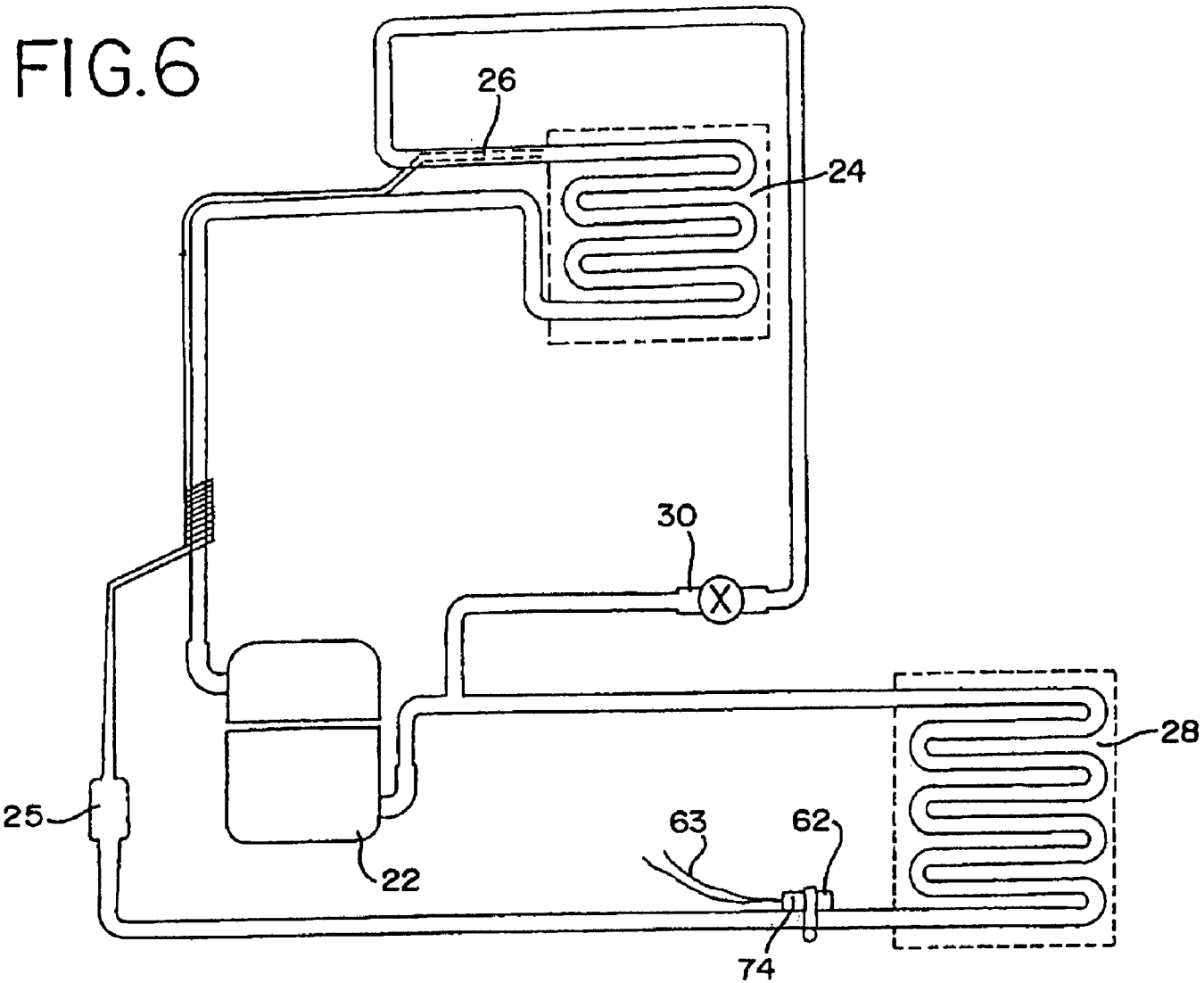
FIG. 6 is a schematic diagram of the refrigeration system of the ice machine of FIG. 1.

The refrigeration system, shown schematically in FIG. 6, includes a compressor 22, a condenser 28, an evaporator 24 and an expansion device in the form of a capillary tube 26. The compressor 22 and condenser 28 are housed in the base of the ice machine 10. The evaporator is in the form of serpentine tubing or coils mounted on the back of the ice-forming device 48 (FIG. 3). Normally refrigerant flows from the compressor 22 to the condenser 28, through the capillary tube 26 and to the evaporator 24. However, during the harvest cycle, a hot gas bypass valve 30 opens and allows hot refrigerant to flow directly to the evaporator 24 from the compressor 22. The refrigeration system preferably also includes a dryer 25 just upstream from the capillary tube 26. The capillary tube 26 is routed to the inlet side of the evaporator 24. The capillary tube 26 has a very small diameter and functions as a restriction, providing a measured amount of resistance to the flow of refrigerant there through. The refrigerant is in a liquid form as it enters the capillary tube 26, and is then allowed to expand in the evaporator into a gas. The restricted flow capillary tube 26 thus serves as an expansion device. The capillary tube 26 is wrapped around the refrigerant line connected to the suction side of the compressor 22 and then follows the outside wall of this refrigerant line and then enters the refrigerant line on the inlet side of the evaporator 24 as shown by the dotted lines in FIG. 6. The contact between the capillary tube and the suction side refrigerant line establishes good thermal contact between the lines, providing heat transfer for the refrigerants inside, as explained in U.S. Pat. No. 5,065,584, which is hereby incorporated by reference. For the most part, the details of the refrigeration system are not critical to the invention, but rather are within the ordinary skill in the art, and are therefore not described in further detail. It is noted however, that as with other small ice machines, having the correct amount of refrigerant in the refrigeration system is highly important to the proper functioning of the machine.

Figure 7:
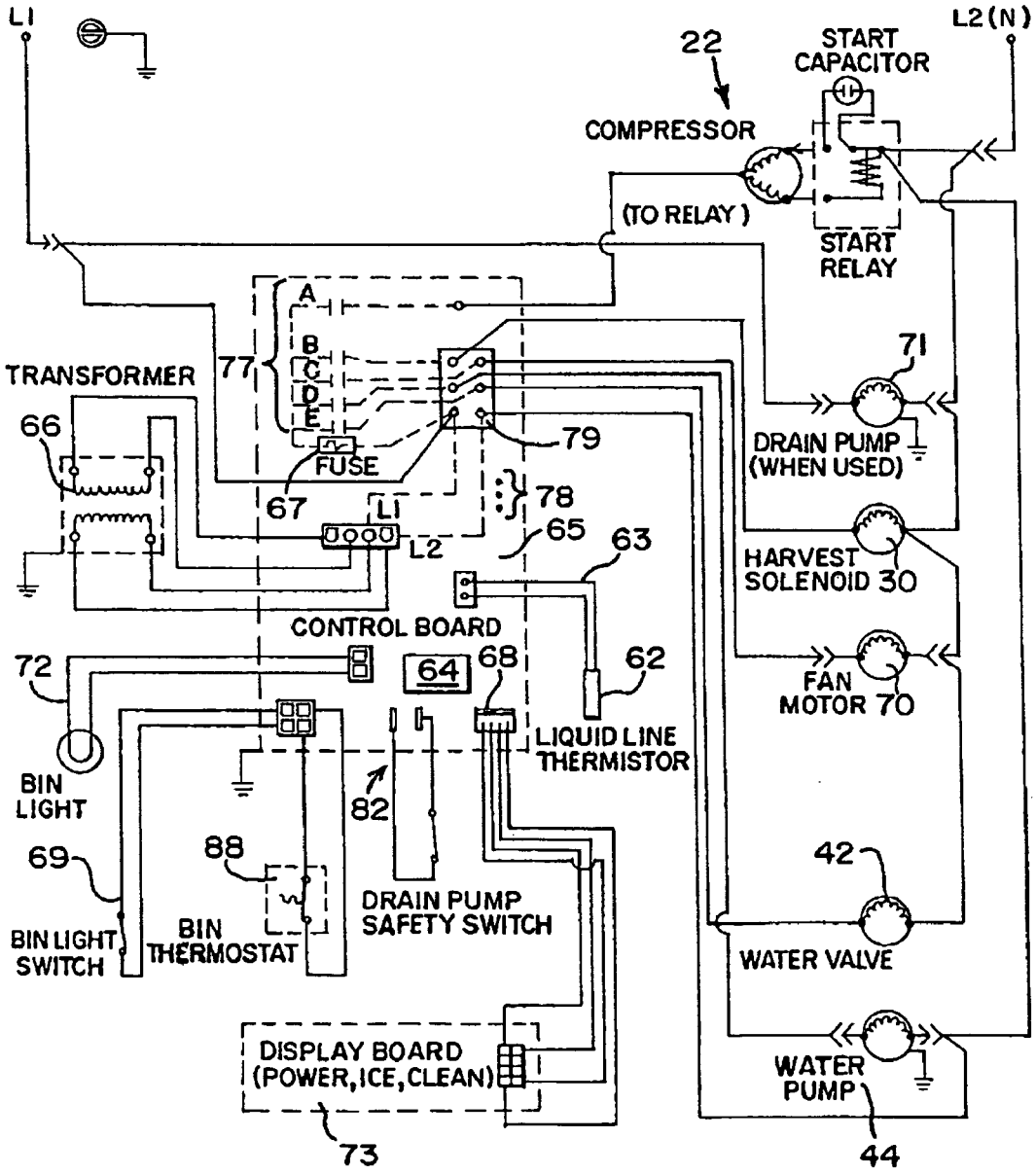
FIG. 7 is a schematic diagram of the electrical system used in the ice machine of FIG. 1.

The control system for the ice making machine 10 includes very few components. The control system includes components mounted on two circuit boards in the machine, a control board 65 and a user interface/display board 73 (FIG. 7). The control board 65 is housed in an electrical box 61 in the top front of the machine. The user interface/display board 73 is also located in the top part of the machine 10, but is visible when the door 14 is opened. A protective overlay is used to cover the buttons on the interface/display board 73 to provide an aesthetic look and a touch pad.

As described above, a temperature sensing device, preferably an aluminum encapsulated thermistor 62, is located on the outlet side of the condenser 28. The preferred thermistor 62 is part No. 3470-103 from Advanced Thermal Products, St. Mary's, Pa.

Preferably the thermistor 62 is in good thermal contact on a straight piece of the refrigerant line, and may be held in place by a tube clamp 74 (FIG. 6). The thermistor is a thermal variable resistor, the resistance of which changes proportionally to its temperature. A pair of wires 63 connect the thermistor 62 with the control board 65. A current of known voltage is supplied to the thermistor 62. As the temperature of the refrigerant exiting the condenser 28 changes, the refrigerant tubing and aluminum encapsulation quickly transfer heat by conduction and cause the temperature, and hence the resistance, of the thermistor 62, to also change. As a result, the voltage drop across the thermistor 62 constitutes an electrical output proportional to the temperature of the refrigerant line. This electrical output, i.e. voltage drop, is then used as an input within the rest of the control system.

The preferred control system of the present invention includes a microprocessor 64 mounted on the control board 65, depicted in FIG. 7. Also mounted on control board 65 are a fuse 67, a socket and plug 68 by which the display board 73 attaches to the control board 65, five relays 77A, B, C, D, and E, jumper pins 78, wiring to a bin light switch 69 and wiring to a bin light 72. A transformer 66 is also connected to the control board 65. Another socket and plug 79 connects other component wiring to the control board 65. Line voltage is supplied to the control board 65 and other components through electrical wires L1 and L2.

The jumper pins 78 are used to tell the control board 65 which model of machine it is being used in. A connector may be placed across two of the pins to indicate that the machine is one that makes regular sized ice cubes, or across a different combination of pins to indicate that the control board is being used in a model of machine that makes small ice cubes.

A high pressure cutout switch (not shown) may optionally be connected to the control board 65. The high pressure cutout is a well known safety device required when water cooled condensers are used. If the machine 10 is located where waste water from the machine cannot drain by gravity to a sewer line, a drain pump 71 may be used. Such drain pumps often include a safety back up switch that can be wired to the main device to shut off the main device if the drain pump fails. Jumper wires 82 may be used to connect the safety back up switch of such a drain pump so that the ice machine 10 can be shut down if such a drain pump fails. If both a drain pump and a high pressure cutout are used, the drain pump safety back up switch and the high pressure cutout switch can be wired in series using jumper wires 82 so that either switch may be used to shut down the machine.

FIG. 7 also shows the electrical wiring for the other components of the machine, such as a fan 70 that draws air passed the condenser, the water pump 44, the hot gas solenoid valve 30 and the water inlet solenoid 42. The compressor 22 preferably has a built in overload protector as well as a starting capacitor and relay. The control system preferably also includes a bin thermostat 88 to detect when the ice bin 36 has sufficient ice in it that the refrigeration system can be shut down. The bin thermostat uses a pliable capillary tube, as is well known in the art. To protect the capillary tube, a nickel plated copper tube (not shown) is secured in the ice bin 36 and acts as a well to house the bin thermostat capillary tube. The bin thermostat 88 preferably includes a knob and dial to allow adjustments to the thermostat based on altitude, as is conventional in the art.

Relay 77A is used to control the compressor. Relay 77B is used to control the hot gas defrost valve (also known as the harvest valve) 30. Relay 77C is used to control the condenser fan motor 70. Relay 77D is used to control water pump 44. Relay 77E is used to control the water inlet valve 42. If desired, some of these relays may be used to control more than one device. For example, the hot gas bypass valve 30 and water inlet valve 42 may both be opened by energizing a single relay so that when a harvest cycle begins, fresh water is also added to the water reservoir 46. As the water reservoir will be refilled before the harvest cycle finishes, the continued addition of water causes water in the reservoir 46 to overflow the tube, rinsing away impurities that would otherwise build up as pure water freezes into ice.

Figure 4:
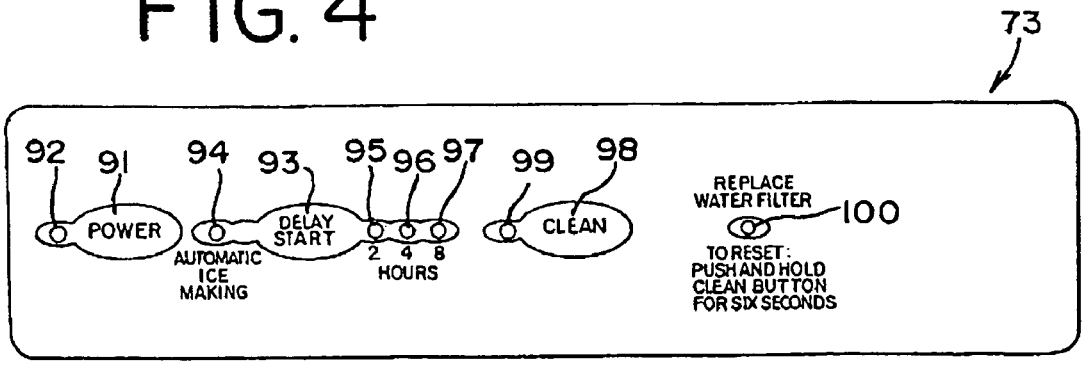
FIG. 4 is an elevational view of the control panel of the ice machine of FIG. 1.

The user interface/display board 73 included three push buttons and seven indicator lights. The push buttons are preferably momentary switches. As best seen in FIG. 4, the first push button 91, labeled as "POWER," is the main power button. Pushing and releasing this button either turns the power to the machine on or off. The first indicator light 92 is used to indicate whether the power to the machine is on or not. The second push button 93, labeled as "DELAY START," is used to activate an automatic restart system, described more fully below. The second indicator light 94 is located between the first and second push buttons. This indicator is labeled "AUTOMATIC ICE MAKING." Three more indicator lights 95, 96 and 97 are located to the right of the second push button. The third pushbutton 98 is labeled as "CLEAN," and is used to put the machine into a cleaning routine, also described below. Indicator light 99 to the left of push button 98 is used to indicate when the machine is in a cleaning cycle. The last indicator light 100 is used to indicate when the filter 34 should be changed.

Figure 8:
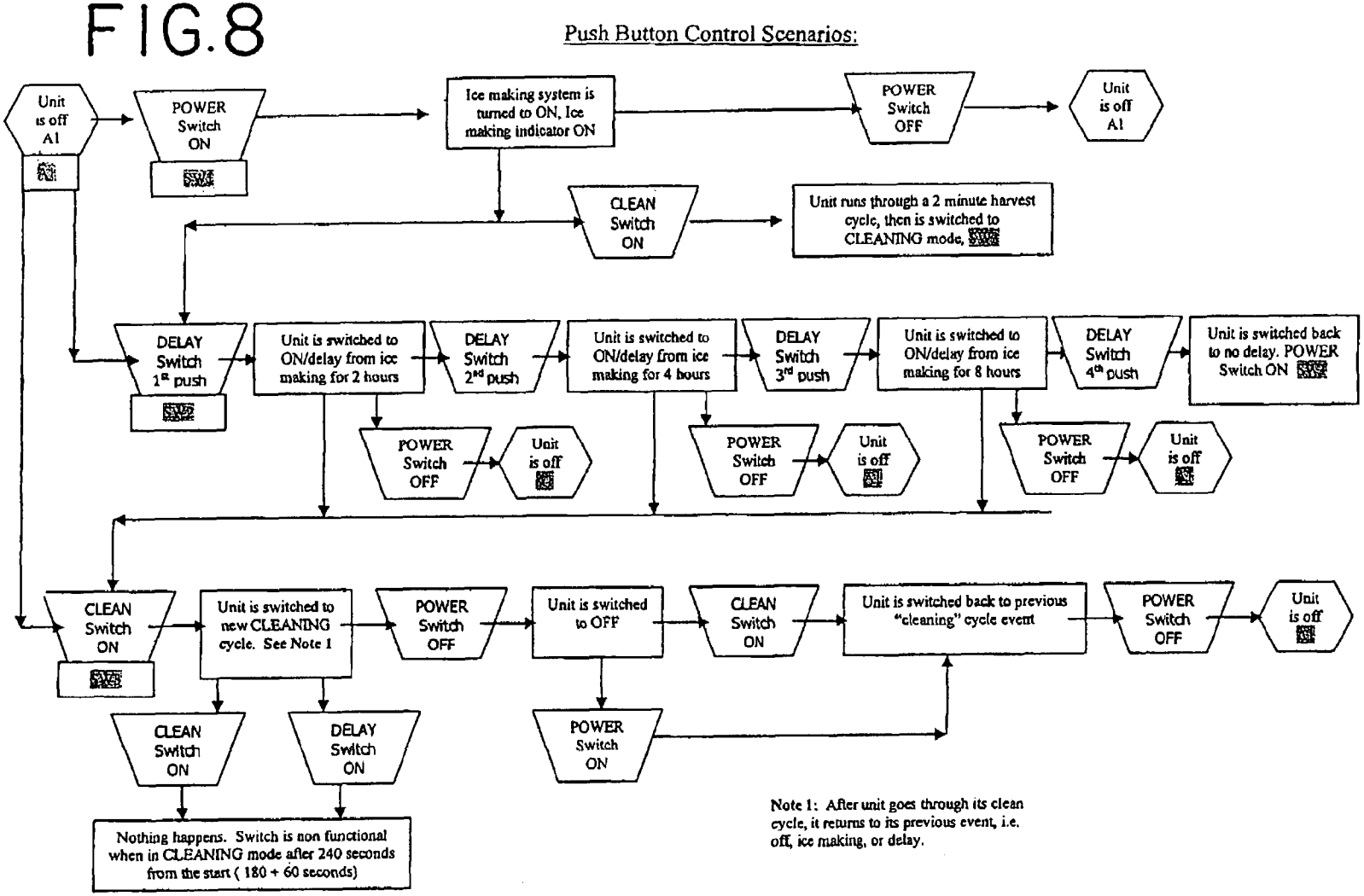
FIG. 8 is a flow chart of the push button control scenarios used to control the microprocessor of the controller of the ice machine of FIG. 1.

The microprocessor 64 includes a computer program that uses various inputs to control the ice making components of the machine 10. The various scenarios for the push button inputs into the microprocessor are detailed in FIG. 8. As seen in FIG. 8, if the DELAY START button 93 is pushed once, the machine will shift from the normal ice making mode to a delay mode for two hours, and then automatically restart (depending on the POWER and CLEAN button settings). If the DELAY START button 93 is pushed a second time while in a delay mode, the restart period will be incremented up to four hours. If the DELAY START button 93 is pressed a third time, the automatic restart period is incremented up to eight hours. If it is pressed a fourth time, the delay is cancelled. In this manner, a user may easily put the ice making machine into a mode where it is quiet, but the user does not have to do anything further to remember to restart the machine. It will automatically restart at the end of the desired delay period.

In addition to the push button inputs, the microprocessor 64 is programmed to use input from the temperature sensing device, such as the thermistor 62, at a predetermined time after initiation of a freeze cycle to determine the desired duration of the freeze cycle and control the refrigeration system and the water system to operate in a freeze cycle until the end of the desired duration and then operate in a harvest cycle. Alternatively, or, more preferably, in addition, the microprocessor 64 is programmed to use input from thermistor 62 at a predetermined time prior to the end of the freeze cycle to determine the desired duration of the harvest cycle. When the duration of the freeze cycle is determined by the microprocessor 64, it will be simple for the microprocessor to also take a temperature measurement at a predetermined period of time before the end of the freeze cycle. If the freeze cycle is ended by some less preferred mechanism, the microprocessor could maintain a floating memory of temperature, and use the temperature in such memory one minute earlier than when the freeze cycle is terminated.

Figure 10:
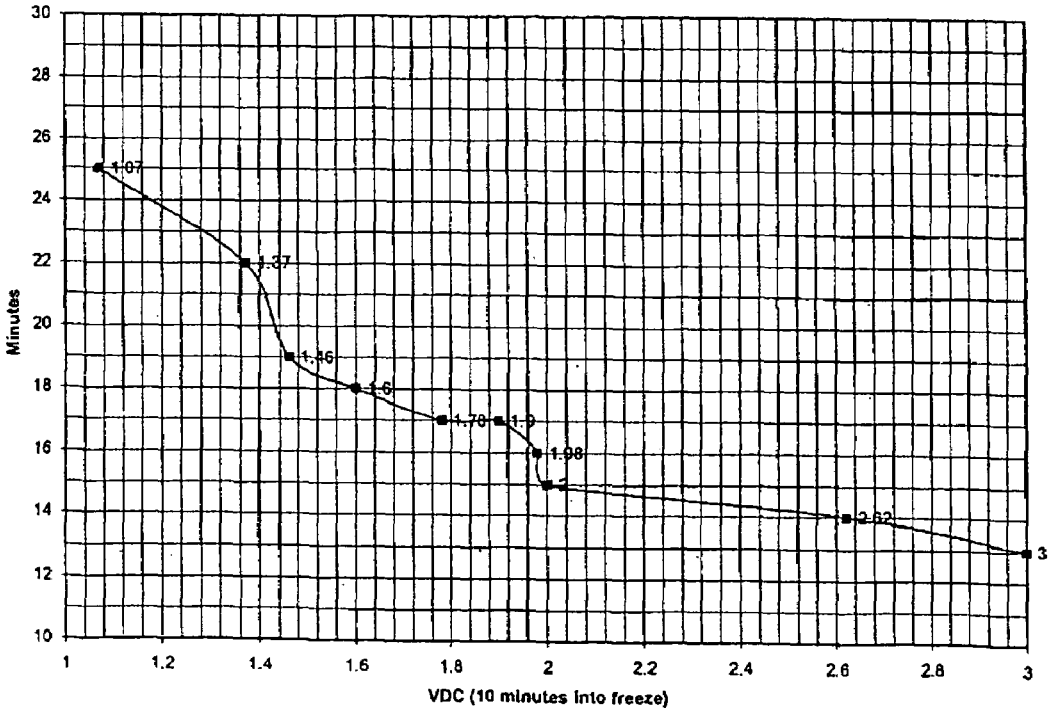
Figure 11:
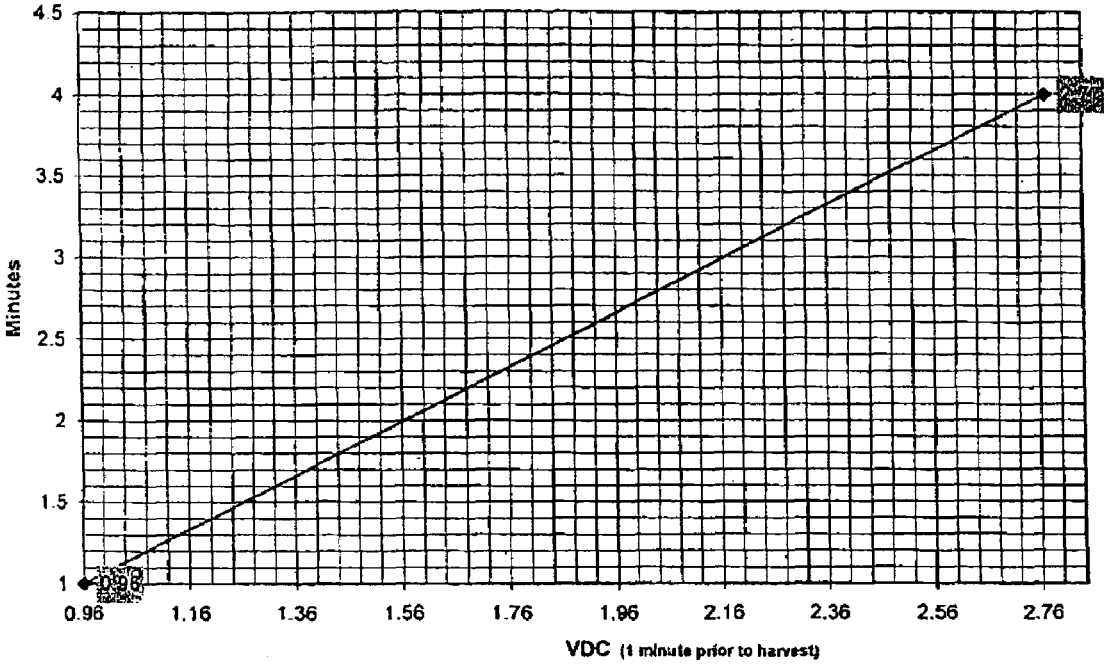
FIGS. 11 and 12 are each graphs of the relationship between the optimum base harvest cycle duration and the voltage from the thermistor, which is proportional to the temperature of the refrigerant exiting the condenser, measured one minute before the end of the freeze cycle.
Figure 12:
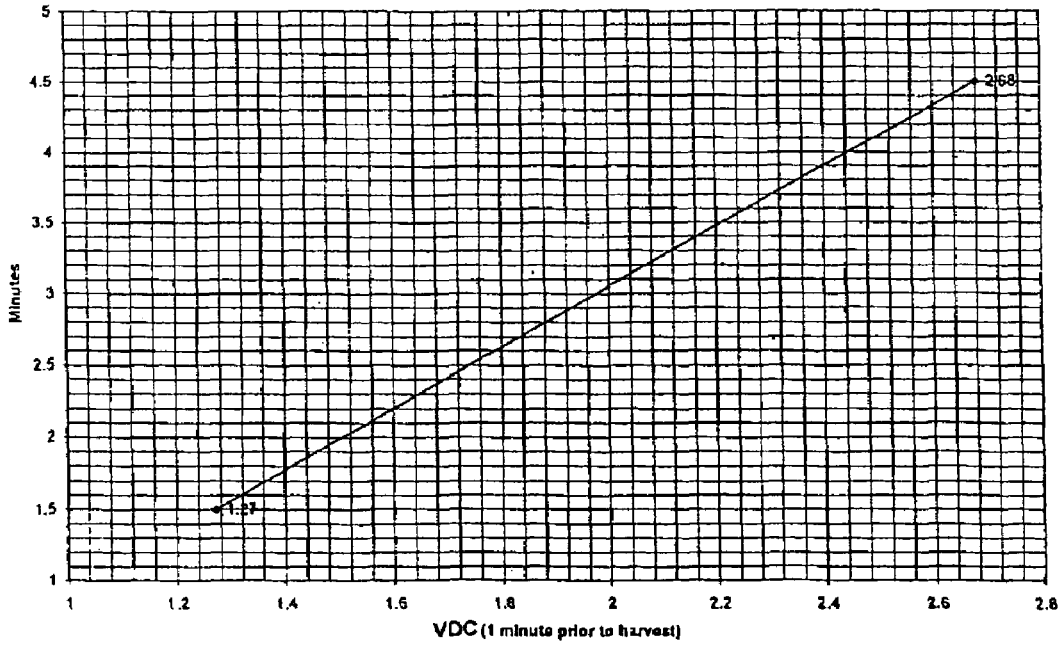

The temperature, or more preferably the thermistor readings used by the microprocessor, is read directly 6.25 times per second. Alternatively an average reading over a short period of time could be used. The microprocessor 64 preferably includes recorded data of optimum freeze and harvest cycle durations compared to thermistor readings which are representative of temperature measurements. The data for the preferred ice machine 10 is shown in FIGS. 9 to 12. The data may be in the form of mathematical formulas modeling the curves shown in these figures. Preferably, however, the data will be in the form of a look-up tables which are used to determine these desired durations, based on a voltage coming back from the thermistor 62. The harvest times on FIGS. 11 and 12 are based on actual harvest times as measured at two conditions, but include an approximate 10% increase in the actual harvest time to make sure that the harvest time will be long enough. This extra 10% accounts for "stack-up" tolerance differences between different machines.

The ice making machine 10 has a normal operating mode, a "DELAY" restart mode and a "CLEAN" operating mode. The function of the push buttons 91, 93 and 98 are outlined in Table 1.

TABLE 1

| Function | Definition |
|---|---|
| Power (Ice Making) Push button 91 | Push once - Unit is turned on for ice making.<br>The LED 92 by the Power switch is on<br>The LED 94 by the "Automatic Ice Making" terminology is on and remains on even if machine is off due to a full bin of ice.<br>Push off - Unit will be turned off of ice making.<br>The LED 92 by the Power switch is off<br>The LED 94 by the "Automatic Ice Making" terminology is off |
| Clean Push button 98 | Push once - Unit will go into a cleaning mode.<br>The LED 92 by the Power switch is on<br>The LED 99 by the Clean switch is on (also flashes at appropriate time to indicate to the user to add cleaner to ice machine)<br>The LED 94 by the "Automatic Ice Making" terminology is off |
| Ice Making Delay Push button 93 | This function suspends ice making/harvesting. The unit will go into a 2, 4, or 8-hour delay from ice making, and then automatically restart.<br>Pressing the delay button 93 up to four times determines the delay time: One push delays the unit 2 hours, two pushes delays the unit 4 hours, three pushes delays the unit 8 hours, and four pushes sets the delay back to 0 delay, its original state.<br>Corresponding LEDs 95, 96 and 97 are on according to the amount of delay. |
| Replace Filter Indicator 100 | The control board will alert the operator to replace the filter after 8,000 harvest cycles. (approx 6 months at 75% @70/50) LED 100 will turn on<br>Holding the Clean button 98 down for 6 seconds will turn off the LED 100, and reset the replace filter counter/timer to zero. There is no means to deactivate the filter light if no filter is installed. |
| Freeze Time Adjustment Program | Pressing and holding the Power button 91 for 5 seconds will initiate the finishing time display, by flashing the Automatic Ice Making cycle LED 94 the number of times for the number of minutes currently selected. This time is added to the base time as outlined in the freeze time chart.<br>To adjust the freeze finishing time, the Power button 91 is pressed and held, and the Clean button 98 is pressed and released. Each time the Clean button 98 is released with the Power button pressed, the finishing time will be incremented by 1 minute. If the current finishing time is 5 minutes, and the Clean button 98 is pressed and released with the Power button 91 pressed, the finishing time will be reset to 0 minutes. |
| Harvest Time Adjustment Program | Pressing and holding the Delay button 93 for 5 seconds will initiate the harvest time adjustment display, by flashing the Automatic Ice Making cycle LED 94 the number of times for the number of 30 second intervals currently selected. This time is added to the base time as outlined in the harvest time chart. To adjust the harvest time, the delay button 93 is pressed and held, and the Clean button 98 is pressed and released. Each time the Clean button 98 is released with the delay button 93 pressed, the harvest time will be incremented by 30 seconds. If the current harvest time is 2.5 minutes, and the Clean button 98 is pressed and released with the Delay button 93 pressed, the harvest time adjustment will be reset to 0 minutes. |

When the POWER button 91 is pushed so as to turn the machine on, the ice machine will normally be making ice unless the bin thermostat 88 indicates that the ice bin 36 is already full. A complete listing of the status of the electrical components (except the bin light 72, which turns on and off when the door is opened and closed) during normal ice making operations is provided in Table 2.

TABLE 2

RESIDENTIAL ICE CUBE MACHINE ON (Ice Making) CYCLE

| | CONTROL INPUTS | | | | CONTROL OUTPUTS | | | | | | |
|---|---|---|---|---|---|---|---|---|---|---|---|
| ICE MAKING SEQUENCE OF OPERATION | POWER SWITCH | DELAY SWITCH | CLEAN SWITCH | BIN THER-MOSTAT | WA-TER PUMP | WATER INLET SOLENOID | HOT GAS VALVE | COM-PRES-SOR | CONDENSER FAN MOTOR | LENGTH OF TIME | NOTES |
| START-UP 1. WATER FILL | ON | OFF | OFF | CLOSED | ON | ON | ON | OFF | OFF | 175 seconds | A |
| 2. REFRI-GERATION START-UP | ON | OFF | OFF | CLOSED | ON | ON | ON | ON | ON | 5 seconds | |
| 3. FREEZE CYCLE | ON | OFF | OFF | CLOSED | ON | OFF | OFF | ON | ON | Based on control board and freeze time adjustment | B |
| 4. HARVEST CYCLE | ON | OFF | OFF | CLOSED | OFF | ON | ON | ON | ON or off | Based on control board and harvest | C |

TABLE 2-continued

| RESIDENTIAL ICE CUBE MACHINE ON (Ice Making) CYCLE | | | | | | | | | | | |
|---|---|---|---|---|---|---|---|---|---|---|---|
| | CONTROL INPUTS | | | | CONTROL OUTPUTS | | | | | | |
| ICE MAKING SEQUENCE OF OPERATION | POWER SWITCH | DELAY SWITCH | CLEAN SWITCH | BIN THER-MOSTAT | WA-TER PUMP | WATER INLET SOLENOID | HOT GAS VALVE | COM-PRES-SOR | CONDENSER FAN MOTOR | LENGTH OF TIME | NOTES |
| 5. AUTOMATIC SHUT-OFF | ON | OFF | OFF | OPEN | OFF | OFF | OFF | OFF | OFF | time adjustment Until bin thermostat re-closes | D |

NOTES:
A. Drain Pump safety switch 82 must be closed for machine to operate (if installed).
B. Freeze end is based on input from the thermistor 62 mounted on refrigeration system condenser liquid line and Programmable finishing freeze timer. Ten (10) minutes into the freeze cycle, the control reads the Volt DC value of the thermistor and, in conjunction with the freeze time adjustment timer, determines how long to stay in the freeze cycle. The Volt DC value also determines if the fan motor remains on or turns off during the harvest cycle. The initial start up cycle will run a 5 minute longer freeze time to compensate for inefficiencies with the initial start-up cycle. All subsequent cycles follow the program/adjustable timer allotments. The maximum freeze time is 120 minutes, at which time the machine enters a harvest cycle.
C. Harvest end is based on a predetermined time set by control board at one (1) minute prior to freeze cycle end. The water pump is re-energized, and the hot gas solenoid and water inlet solenoid are de-energized, and the unit goes back into a freeze cycle (sequence operation #3). One (1) minute prior to finishing freeze cycle the control reads the Volt DC value of the thermistor and in conjunction with the harvest time adjustment timer, determines how long to stay in the harvest cycle. The maximum harvest time is 5 minutes, at which time the machine returns to a freeze cycle sequence operation #3.
D. When the bin thermostat is open all components turn off. When the bin thermostat re-closes, it restarts using the startup sequence described in steps 1 and 2.

On the initial startup of the machine, or restart of the machine after the bin thermostat indicates additional ice is needed, the first thing that happens is that the hot gas bypass and water inlet solenoids 30, 42 are energized. This allows the water reservoir 46 to fill up. The compressor 22 is energized after the hot gas and water inlet solenoids are energized for 175 seconds. The compressor runs for five seconds with the hot gas bypass valve open, which makes it easier to start the compressor. After this five seconds, the water pump 44 and condenser fan motor 70 are energized, and the hot gas and water inlet solenoids 30, 42 are deenergized. The machine is now in a freeze cycle, with the compressor, water pump, and condenser fan motor energized, and the hot gas and water inlet solenoids deenergized. Ten minutes into the freeze cycle, the microprocessor 64 reads the voltage returning from the thermistor 62 and determines how long to remain in the freeze cycle by using the data in FIG. 9 (or FIG. 10 if the machine is designed to make small cubes and the jumper pins 78 on the control board are so connected) and the manually controllable freeze time adjustment. One minute prior to finishing this freeze time, a second resistance reading of the thermistor 62 is made to determine the length of the harvest cycle and whether to run the condenser fan during the harvest cycle, using the data from FIG. 11 (or FIG. 12, depending on the connections of the jumper pins 78) and the manually controllable harvest time adjustment. When the freeze cycle is completed, the control system deenergizes the water pump 44 and energizes the hot gas and water inlet solenoids 30, 42 for the harvest cycle duration. The compressor 22 remains energized during the harvest cycle. At the conclusion of the harvest cycle, the machine returns to a new freeze cycle, with the compressor 22 and water pump 44 both energized. The hot gas and water inlet solenoids 30, 42 are deenergized.

Figure 9:
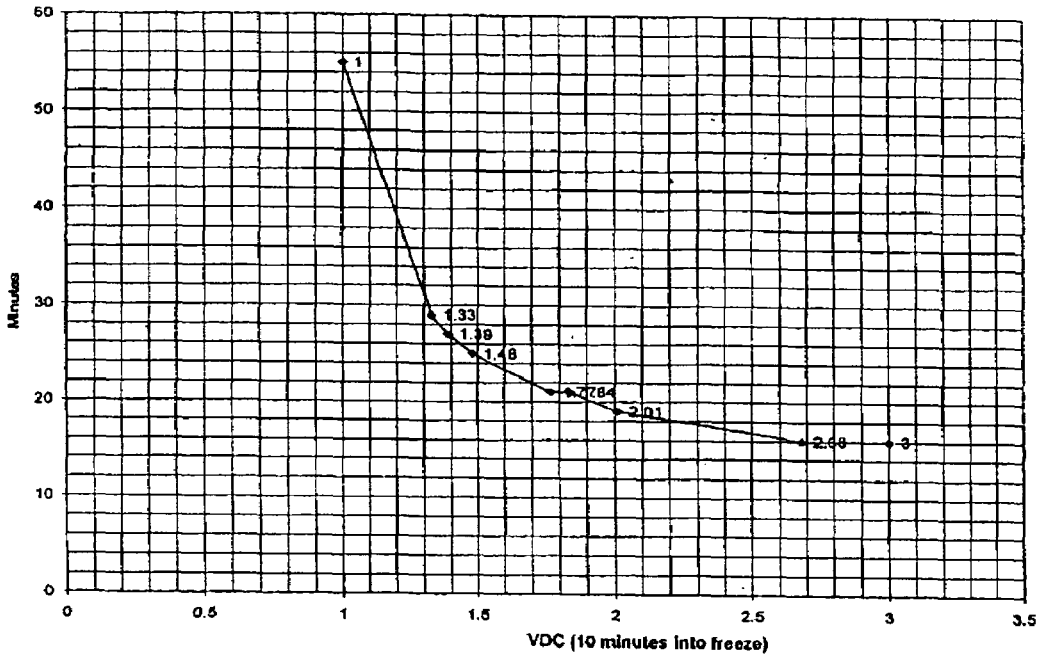
FIGS. 9 and 10 are each graphs of the relationship between an optimum base freeze cycle duration and the voltage from the thermistor, which is proportional to the temperature of the refrigerant exiting the condenser, measured ten minutes after the freeze cycle begins. The graph of FIG. 9 is used for a model of the ice machine of FIG. 1 that makes regular size cubes, and the graph of FIG. 10 is for a second model of the same basic machine but which makes smaller cubes.

On the initial startup cycle, when the freeze cycle starts and the compressor has not been running, the run time for the freeze cycle will be five minutes longer than the normal time determined from the look-up table (see FIG. 9). This is accomplished by running the compressor for five minutes before starting the 10 minute time. As a result, in this first cycle, the thermistor voltage is actually measured after 15 minutes of running time. This incremental increase in the initial freeze cycle compensates for inefficiencies associated with the initial startup cycle. All subsequent freeze cycle durations follow the programmed time based on the look-up table and the manually adjustable factor. The machine will continue to cycle through freeze and harvest cycles until the bin thermostat 88 opens, breaking power to the control board. When the bin thermostat recloses, the machine restarts as outlined above.

The same temperature reading one minute before the end of freeze that is used to determine the base duration of the harvest cycle is used to determine whether the condenser fan should be operated during the harvest.

The data in Table 3 below gives the look-up table data plotted in FIGS. 9 and 11 for a standard size cube

TABLE 3

| DATA FOR FREEZE HARVEST CYCLE DURATIONS FOR STANDARD CUBE | | |
|---|---|---|
| | Check point: 10 minutes | |
| Point | Time (min) | Voltage (VDC) |
| Harvest point #1: | 1 | 0.96 |
| Harvest point #2: | 4 | 2.77 |
| Freeze point #0: 110/90 | 55 | 1 |
| Freeze point #1: 90/90 | 29 | 1.33 |
| Freeze point #2: 90/70 | 27 | 1.39 |
| Freeze point #3: 90/50 | 25 | 1.48 |
| Freeze point #4: 77/59 | 21 | 1.77 |
| Freeze point #5: 70/90 | 21 | 1.84 |
| Freeze point #6: 70/70 | 21 | 1.84 |
| Freeze point #7: 70/50 | 19 | 2.01 |
| Freeze point #8: 50/50 | 16 | 2.68 |
| Freeze point #9: | 16 | 3 |

Note:
This data is for the freeze adjustment timer set at 0. The designations "110/90", "90/70" etc. indicate approximate ambient air/water temperatures in ° F. that would generate the data point of the optimum freeze time.

The data in Table 4 below gives the look-up table data plotted in FIGS. 10 and 12 for a small sized ice cube

TABLE 4

| DATA FOR FREEZE HARVEST CYCLE DURATIONS FOR SMALL CUBES | | |
|---|---|---|
| | Check point: 10 minutes | |
| Point | Time (min) | Voltage (VDC) |
| Harvest point #1: 110/90 | 1.5 | 1.27 |
| Harvest point #2: 50/50 | 4.5 | 2.68 |
| Freeze point #0: 110/90 | 25 | 1.07 |
| Freeze point #1: 90/90 | 22 | 1.37 |
| Freeze point #2: 90/70 | 19 | 1.46 |
| Freeze point #3: 90/50 | 18 | 1.6 |
| Freeze point #4: 77/59 | 17 | 1.78 |
| Freeze point #5: 70/90 | 17 | 1.9 |
| Freeze point #6: 70/70 | 16 | 1.98 |
| Freeze point #7: 70/50 | 15 | 2 |
| Freeze point #8: 50/50 | 14 | 2.62 |
| Freeze point #9: | 13 | 3 |

Note:

This data is for the Finish timer set at 0.

Table 5 shows the conditions for whether the condenser fan will operate during the harvest cycle.

TABLE 5

| Time in minutes from Freeze time chart | DC Voltage From Freeze Time chart | Fan on/off during harvest |
|---|---|---|
| 55 | 1 | ON |
| 29 | 1.33 | ON |
| 27 | 1.39 | ON |
| 25 | 1.48 | ON |
| 21 | 1.77 | ON |
| 21 | 1.84 | ON |
| 21 | 1.84 | ON |
| 19 | 2.01 | OFF |
| 16 | 2.68 | OFF |
| 16 | 3 | OFF |

The fan motor 70 will turn off during harvest when the voltage 10 minutes into the freeze cycle is a higher then 2.01 DC volt. This corresponds to turning the fan off at approximately 70° F./50° F. (air/water) and below.

When push button 98 is activated, the POWER and CLEAN LEDs 92 and 99 turn on. The microprocessor 64 cycles the system through wash, fill, and rinse cycles that will take a total of approximately 25 minutes. The order of operation of the electrical components is depicted in TABLE 6.

TABLE 6

RESIDENTIAL ICE CUBE MACHINE CLEAN CYCLE

| CLEANING | CONTROL INPUTS | | | | CONTROL OUTPUTS | | | | | | |
|---|---|---|---|---|---|---|---|---|---|---|---|
| SEQUENCE OF OPERATION | ON SWITCH | DELAY SWITCH | CLEAN SWITCH | Bin Ther-mostat | WA-TER PUMP | WATER INLET SOLENOID | HOT GAS VALVE | COM-PRES-SOR | CONDENSER FAN MOTOR | LENGTH OF TIME | NOTES |
| START-UP 1. WATER FILL | ON | OFF | ON | OPEN OR CLOSED | ON | ON | OFF | OFF | OFF | 180 SECONDS | A |
| 2. CLEAN | ON | OFF | ON | OPEN OR CLOSED | ON | OFF | OFF | OFF | OFF | 600 seconds | B |
| 3A. RINSE CYCLE | ON | OFF | ON | OPEN OR CLOSED | ON | ON | OFF | OFF | OFF | 60 seconds | C |
| 3B. FILL CYCLE | ON | OFF | ON | OPEN OR CLOSED | OFF | ON | OFF | OFF | OFF | 30 seconds | C |

NOTES:

A. When the CLEAN button 98 is pressed, LED 99 turns on, but does not flash until after the first 180 seconds.

B. For 60 seconds after the first 180 seconds, the control system can be subjected to other inputs, which would change the operation of the unit. The LED 99 flashes continuously during these 60 seconds, indicating to the operator to add cleaner. After the 60 seconds, the control locks itself in the CLEAN cycle until completion, and the LED 99 stops flashing. To abort the clean cycle after this time, the POWER button 91 will need to be pushed in a series of OFF-ON-OFF to reset the unit to its original start-up condition.

C. Steps 3A and 3B are repeated 8 more times, then the machine automatically goes back into its previous condition, i.e. ice-making, off, or delayed restart.

Notes

1. If the machine is originally in an ice-making mode and the CLEAN button 98 is pushed, the unit goes into a 2-minute harvest cycle, and then goes into the clean cycle. At the conclusion of the clean cycle, the unit goes back into ice-making mode.

2. If the machine is originally off and the CLEAN button 98 is pushed, the unit goes directly into the clean cycle. At the conclusion of the clean cycle, the unit goes back to off.

If the machine is originally in delay and the CLEAN button is pushed, the unit goes directly into the clean cycle. At the conclusion of the clean cycle, the unit resumes the delay cycle. These cycles and the components that are energized are as follows. During the first fill cycle, which lasts 3 minutes, the hot gas and water inlet solenoids 30, 42 are energized. It is at the end of this time that an operator may add a cleaning and/or sterilizing solution to the water reservoir. During the next portion of the clean cycle, which lasts for 10 minutes, the water pump 44 is energized, and the hot gas and water inlet solenoids are not. Thereafter the system cycles through eight repetitions of a rinse and fill cycle. In each rinse cycle the water inlet solenoid is energized for 3 minutes while the pump 44 is on. This pump is then turned off. The rinse cycle is followed by a fill cycle of 30 seconds, in which only the water inlet solenoid is energized. These cycles are repeated eight times. If power is interrupted to the machine, the microprocessor 64 will, when power is restored, start over in a "on" cycle or a "clean" cycle, depending on the push button position.

To further reduce cost, it may be possible to use one relay to control all four of the water pump 44, condenser fan 70, water inlet solenoid 42 and hot gas valve 30. The relay could have two positions. In one position the water inlet solenoid and hot gas valve 30 could be energized, and in the other position the fan 70 and water pump could be energized.

The preferred ice making machine 10 will have the capacity to make about 48 pounds of ice per day at 70/50 and store about 28 pounds of ice in the bin 36. The preferred ice making machine will use R-134A refrigerant, and a stainless steel cabinet 14.

The preferred controller of the present invention provides numerous benefits. First, the automatic restart makes it very convenient for a user to turn off the ice making machine when a period of quiet time is desired, without having to worry about remembering to turn the machine back on. The preferred function to achieve this is a simple push button, with indicator lights to let the user know how long of a period has been selected. The preferred control program allows the user to extend or cancel the delay period even after it is initiated, again by a simple push button.

The water filter change indicator on the preferred ice machine notifies a user when the water filter needs to be changed. By using the a count of the number of harvest cycles, the filter change indicator will be able to accurately indicate when the filter should be changed, rather than being based on a set time duration. Since every ice machine will see different amounts of water usage, but use a fairly consistent amount of water per cycle, the preferred filter change indicator will be set to come on after a predetermined amount of water has been used, whether that occurs in three months or a year.

The preferred control system provides a very good control scheme, increasing the efficiency of the machine, with very few components, and hence a low cost, but allowing the machine to by used in a wide variation of ambient temperatures for air and inlet water. This is particularly advantageous for small ice making machines. The control system works well over a wide range of operating conditions, including partially blocked air flow, dirty condenser and varying ambient temperatures. By using the liquid line temperature at a given time prior to the end of the freeze cycle as the basis for controlling the condenser fan during the harvest cycle, the condenser fan can be turned off as soon as the harvest cycle is initiated, rather than waiting for the temperature in the condenser to reach a certain point. The harvest cycle can then be kept short, yet the fan can be controlled to run during harvest in those instances where the defrost temperature would otherwise be higher than necessary.

The preferred control system, while utilizing the liquid line temperature at different points in the freeze cycle to control the duration of the freeze and harvest cycle, also allows for a manually entered modification to the freeze and/or harvest cycles. The user interface/display board push buttons are easily accessible and can therefore be easily used to make this change, rather than adjusting a potentiometer on a control board that may not be accessible without opening up an electrical box.

The preferred control board can be used on different models of ice making machines that require different operating parameters. By changing the pins that are connected together on the set of jumper pins 78 on the control board, the microprocessor is directed to use the right look-up table for selecting the appropriate freeze and harvest durations for the model of ice making machine into which the control board 65 is installed. In this way only one control board needs to be designed, built and inventoried for making multiple models of ice making machines. Rather than directing the use of just a different look-up table, the jumper pins could indicate that other significant differences exist in the machine (for example, a water cooled condenser instead of an air cooled condenser), and the microprocessor could thus run a different control program that would activate different relays or use different periods of time to thus make other changes in the way that the control board functioned.

It will be appreciated that the preferred embodiments described above are subject to modification without departing from the invention. For example, while the preferred control system provides three set time periods (2, 4 and 8 hours) of delay, other durations and number of options can be programmed into the machine. Further, if desired, the microprocessor could allow a user to program in a set period every day, or several set periods during the week, when the ice machine would be shut down and automatically restart. Other changes that are contemplated include other defrost systems rather than a hot gas bypass valve that could be initiated by a microprocessor. Further, the condenser fan could be controlled so as to turn off shortly before the end of a freeze cycle under conditions that the condenser fan will need to be off during the harvest cycle. Rather than using jumper pins 78, a switch could be located on the control board, with the position of the switch indicating the model of ice machine the control board is being used in. The curves in FIGS. 11 and 12 can be changed to reflect additional data points, such as using five data points rather than a straight line between two data points on the curves for the harvest time. The number of cycles that will be counted to indicate when the water filter will be changed may be different, depending on the amount of water used in each cycle and the recommended filtration capacity for the filter being used. Therefore it should be understood that the invention is to be defined by the following claims rather than the preferred embodiments described above.

We claim:

1. An automatic ice making machine comprising:

a) a refrigeration system comprising a compressor, a condenser, an evaporator and an expansion device;

b) a water system comprising a water circulation mechanism and an ice forming surface in thermal contact with the evaporator; and c) a control system comprising:

i) an on/off selector that causes the control system to either operate the compressor and water system so that the ice making machine automatically makes and harvests ice, or shuts the machine off until manually turned on; and ii) an automatic restart selector that causes the control system to shut down the water circulation mechanism and stop automatically forming and harvesting ice for a predetermined period of time and then automatically resume ice making.

2. The ice making machine of claim 1 wherein the automatic restart selector allows a user to select a period of time that the compressor will be off, and the control system automatically restarts the compressor after the expiration of the selected period of time.

3. The ice making machine of claim 2 further comprising an ice storage bin and a sensor to determine if ice in the bin has reached a full condition, wherein the control system restarts the compressor after the predetermined period of time only after also checking to see that the sensor does not indicate a bin full condition; and, if the sensor indicates a bin full condition on the expiration of the predetermined period of time, delays the restart until the sensor no longer indicates a bin full condition.

4. The ice making machine of claim 2 wherein the water system comprises a water circulation mechanism and the control system restarts the compressor and water circulation system after expiration of the predetermined period of time.

5. The ice making machine of claim 1 wherein the control system includes a user interface panel and the automatic restart selector comprises a push button on the user interface panel.

6. The ice making machine of claim 5 wherein activation of the push button different numbers of time in a repeated fashion selects different predetermined periods of time after which the automatic restart will occur.

7. The ice making machine of claim 6 wherein activation of the push button one time generates a two hour period that the ice making machine will be off and then automatically restart.

8. The ice making machine of claim 6 wherein activation of the push button twice generates a four hour period that the ice making machine will be off and then automatically restart.

9. The ice making machine of claim 6 wherein activation of the push button three times generates a eight hour period that the ice making machine will be off and then automatically restart.

10. The ice making machine of claim 6 wherein activation of the push button four times cancels the automatic restart cycle.

11. The ice making machine of claim 1 further comprises an indicator that indicates the period of time selected by the automatic restart selector.

12. The ice making machine of claim 11 wherein the indicator comprises multiple LED's mounted on a user interface panel, with indica on the panel associated with each LED to indicate a period of time designated by that LED.

13. The ice making machine of claim 1 wherein the control system further comprises a clean cycle operation.

14. The ice making machine of claim 1 wherein the ice forming surface is shaped to form cubes of ice, and the control system includes a harvest cycle operation to cause ice cubes to be released from the ice forming surface.

15. The ice making machine of claim 14 wherein the ice forming surface comprises pockets into which water is sprayed from below, and the ice cubes are formed in the pockets.

16. The ice making machine of claim 1 wherein the machine produces flaked ice.

17. The ice making machine of claim 1 wherein the machine produces nugget ice.

18. The ice making machine of claim 4 wherein the control system restarts the compressor and water circulation system at different times after expiration of the predetermined period of time.

19. The ice making machine of claim 3 wherein the sensor to determine if ice in the bin has reached a full condition comprises an ice bin thermostat.

20. The automatic ice making machine of claim 1 wherein the water system comprises a water filter and the control system comprises a filter change indicator, whereby an indication is displayed after a predetermined condition is reached indicating that the water filter should be replaced.

21. The ice making machine of claim 20 wherein the ice making machine makes and harvests ice in repeated cycles, and the predetermined condition comprises a set number of harvest cycles.

22. The ice making machine of claim 21 wherein the ice forming surface forms ice cubes and a harvest cycle involves warming the ice forming surface to release ice cubes there from.

23. The ice making machine of claim 21 wherein the set number of harvest cycles is between about 4,000 and about 12,000 harvest cycles.

24. The ice making machine of claim 21 wherein the set number of harvest cycles is about 8000 harvest cycles.

25. The ice making machine of claim 21 wherein the control system includes an reset function allowing a user to indicate to the control system to restart the count of harvest cycles for determining when the filter needs to be changed again.

26. The ice making machine of claim 20 wherein the filter change indicator comprises a light.

27. The ice making machine of claim 26 wherein the light is illuminated to indicate that the predetermined condition has been met.

28. The automatic ice making machine of claim 1 wherein the condenser has an inlet and an outlet, and the refrigeration system further comprises a condenser fan and a liquid line for transferring refrigerant from the condenser to the expansion device; and the control system further comprises a sensor to determine the temperature of the liquid line and a program that controls operation of the condenser fan during a harvest mode based on the temperature of the liquid line.

29. The ice making machine of claim 28 wherein the expansion device comprises a capillary tube.

30. The ice making machine of claim 28 wherein the condenser fan is controlled to be either on or off.

31. The ice making machine of claim 28 wherein the temperature of the liquid line is taken at a point between about 1 and about 3 inches downstream of the outlet of the condenser.

32. The ice making machine of claim 28 wherein the sensor generates a voltage proportional to the liquid line temperature and the control system uses that voltage as a determination of the temperature of the liquid line.

33. The ice making machine of claim 28 wherein the liquid line temperature sensor comprises a thermistor.

34. The ice making machine of claim 33 wherein the thermistor is encapsulated in aluminum.

35. The ice making machine of claim 28 wherein the control program uses the temperature of the liquid line at a predetermined time prior to initiation of the harvest mode to control the condenser fan.

36. The ice making machine of claim 35 wherein the control program continuously monitors the temperature of the liquid line, and uses the temperature of the liquid line at a set time prior to the machine beginning a harvest mode to control the condenser fan.

37. The ice making machine of claim 36 wherein the control program uses the temperature of the liquid line at a time of about 1 minute before the beginning of the harvest mode to control the condenser fan.

38. The ice making machine of claim 28 wherein the control system comprises a microprocessor to run said program.

39. The ice making machine of claim 38 wherein the refrigeration system further comprises a hot gas bypass valve and the microprocessor controls the hot gas bypass valve to initiate freeze and harvest cycles.

40. The automatic ice making machine of claim 1 wherein the refrigeration system further comprises a liquid line for transferring refrigerant from the condenser to the expansion devices and the control system further comprises a sensor to determine the temperature of the liquid line and a control board having a microprocessor thereon programmed to use input from the sensor to determine at least one of a desired duration of a freeze cycle and a desired duration of a harvest cycle, and to thereafter control the refrigeration and water systems to operate in accordance with the desired duration or durations; the control board being changeable so that it can be used to appropriately control different models of ice making machines, with the microprocessor determining different durations based on the same sensor temperature, depending on the changed aspect of the control board.

41. The ice making machine of claim 40 wherein the control board comprises a set of pins and a jumper, and changing the jumper between different pairs of pins changes the control board so that it can be used to appropriately control another model of ice machine.

42. The ice making machine of claim 41 wherein the microprocessor includes multiple sets of look-up tables, and changing the jumper between different pairs of pins causes the program to refer to different look-up tables to determine the duration of the freeze cycle or harvest durations.

43. The ice making machine of claim 40 wherein the control board comprises a switch, and activating the switch changes the control board so that it can be used to appropriately control another model of ice machine.

44. The ice making machine of claim 40 wherein the refrigeration system further comprises a hot gas bypass valve and the microprocessor controls the hot gas bypass valve to thereby initiate freeze and harvest cycles.

45. The ice making machine of claim 40 wherein the water system further comprises a reservoir and a water inlet solenoid valve is controlled by the microprocessor.

46. The ice making machine of claim 40 wherein the microprocessor is programmed to operate the water system and refrigeration system in a clean cycle in which fresh water is repeatedly introduced into the ice making machine and circulated by a water circulating mechanism while the compressor is off.

47. A method of operating an automatic ice making machine having a refrigeration system comprising a compressor, a condenser, an evaporator and an expansion device; a water system comprising an ice forming surface in thermal contact with the evaporator; and a control system; the method comprising:

a) a user putting the control system into a mode where the refrigeration and water systems are used to automatically form and harvest ice;

b) a user signaling the control system to stop automatically forming and harvesting ice for a predetermined period of time during which the refrigeration and water systems are inactive; and c) the control system automatically resuming the ice forming and harvesting mode after the expiration of the predetermined period of time without user intervention.

48. The method of claim 47 wherein the ice making machine further comprises an ice storage bin and a sensor to indicate when ice in the bin reaches a full condition; and wherein the control system, when in the ice forming mode, automatically shuts down the refrigeration system when the sensor indicates a bin full condition and automatically restarts the refrigeration system when the sensor no longer indicates a bin full condition.

49. The method of claim 47 wherein the step of signaling the control system to stop automatically forming and harvesting ice for a predetermined period of time comprises activating a push button.

50. The method of claim 49 wherein the predetermined period of time is a function of the number of times that the push button is activated.

51. The method of claim 47 wherein the refrigeration system further comprises a condenser fan and the ice machine is operated to control the condenser fan by:

i) initiating a freeze cycle during which refrigerant is compressed by the compressor and discharged to the condenser, from which the refrigerant flows in a liquid line to the expansion device, through the evaporator and back to the compressor;

ii) measuring the temperature of the refrigerant leaving the condenser at a predetermined time before termination of the freeze cycle; and iii) using the temperature measured in step ii) to determine whether the condenser fan should operate during the harvest cycle.

52. The method of claim 51 wherein the predetermined time prior to termination of the freeze cycle in step ii) is about 1 minute.

53. The method of claim 51 wherein the measured temperature in step iii) is an average of a series of temperature measurements taken over a short period of time.

54. The method of claim 53 wherein the short period of time is less than 1 second.

55. The method of claim 53 wherein the series of temperature measurements are made by determining the resistance of a thermistor in thermal contact with the liquid line downstream of the condenser.

56. The method of claim 51 wherein an electrical output is generated by the sensor proportional to the temperature of the liquid line.

57. The method of claim 56 wherein the electrical output is used as an input to a microprocessor, and the microprocessor determines whether the condenser fan will operate in the ensuing harvest cycle from the electrical output of the sensor.

58. The method of claim 57 wherein the sensor is a thermistor and the electrical output is a voltage drop across the thermistor.

59. The method of claim 58 wherein the voltage drop across the thermistor is compared to recorded data comparing voltage drops and desired condenser fan operation to determine whether to operate the condenser fan during the ensuing harvest cycle.

60. The method of claim 47 further comprising controlling a harvest cycle duration of the ice making machine by:

i) initiating a freeze cycle during which refrigerant is compressed by the compressor and discharged to the condenser, from which the refrigerant flows in a liquid line to the expansion device, through the evaporator and back to the compressor;

ii) measuring the temperature of the refrigerant leaving the condenser at a predetermined time before termination of the freeze cycle;

iii) using the temperature measured in step ii) and a controllable factor to determine the desired duration of a harvest cycle during which refrigerant bypasses the condenser and flows to the evaporator; and iv) ending the harvest cycle after the length of time determined in step iii).

61. The method of claim 60 wherein the controllable factor comprises a manually entered modification input from a user interface.

62. The method of claim 61 wherein the user interface comprises at least one push button.

63. The method of claim 61 wherein the user interface comprises at least first and second push buttons, and modification of the controllable factor comprises operation of the push buttons wherein the harvest cycle duration is modified one increment of time each time the second button is pressed while the first button is pressed and held.

64. The method of claim 60 wherein the predetermined time period before termination of the freeze cycle at which the temperature of the refrigerant line is measured is at a time during which the refrigerant flow is stable.

65. The method of claim 60 wherein a microprocessor is used to end the freeze cycle and initiate the harvest cycle and the microprocessor includes recorded data comparing results of past temperature measurements and desired freeze cycle durations that is then used in determining the desired duration of the freeze cycle.

* * * * *